US006568627B1

(12) United States Patent
Jones et al.

(10) Patent No.: US 6,568,627 B1
(45) Date of Patent: May 27, 2003

(54) SIDE-SCATTER BEAMRIDER MISSILE GUIDANCE SYSTEM

(75) Inventors: Michael M. Jones, Arab, AL (US); Robert R. Mitchell, Huntsville, AL (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 10/005,821

(22) Filed: Dec. 3, 2001

(51) Int. Cl.[7] ..... F41G 7/24; F41G 7/26
(52) U.S. Cl. ..... 244/3.13; 244/3.11
(58) Field of Search ..... 244/3.1, 3.11, 244/3.12, 3.13, 3.14

(56) References Cited

U.S. PATENT DOCUMENTS 3,513,315 A * 5/1970 Sundstrom et al. ..... 244/3.13
3,614,025 A * 10/1971 Maillet ..... 244/3.11
4,696,441 A * 9/1987 Jones et al. ..... 244/3.13
5,374,009 A 12/1994 Miller, Jr. et al. ..... 244/3.13
5,664,741 A 9/1997 Duke ..... 244/3.13
6,138,944 A 10/2000 McCowan et al. ..... 244/3.13

* cited by examiner

*Primary Examiner*—Bernarr E. Gregory
(74) *Attorney, Agent, or Firm*—Arthur H. Tischer; Dayn T. Beam; Hay Kyung Chang

(57) ABSTRACT

The Side-Scatter Beamrider Missile Guidance System projects into the guidance field a pulsed beam that is spatially encoded with azimuth and elevation scans of pre-determined angles. This pulsed beam is indirectly relayed to side-looking missile-borne receivers by way of scattered radiation effected by atmospheric particles. Multiple optical receivers mounted on the exterior of the missile, each receiver having a different field-of-view from its adjacent receivers, receive light from the transmitting laser that is thusly scattered by atmospheric particles. In response to the received scattered radiation, the missile's signal processor calculates the missile's position within the guidance field by determining which of the receivers detects the scattered energy and when the detection shifts from that receiver to an adjacent receiver. Subsequently, steering commands are generated to guide the missile to or near the center of the guidance field, which center is normally coaxial with the target line-of-sight.

16 Claims, 7 Drawing Sheets

SIDE-SCATTER BEAMRIDER MISSILE GUIDANCE SYSTEM

DEDICATORY CLAUSE

The invention described herein may be manufactured, used and licensed by or for the Government for governmental purposes without the payment to us of any royalties thereon.

BACKGROUND OF THE INVENTION

Kinetic energy kill mechanisms employed in anti-tank guided missiles (ATGM) are generally produced by impacting the target with a penetrating rod that is carried by a hyper-velocity missile (HVM). In order to achieve the high velocities (generally mach 5 or greater) necessary to produce this kill mechanism, the HVM designer must maximize thrust and minimize drag. These requirements typically dictate a small overall diameter, a sharply tapered nose, a minimum number of appendages (fins, etc.) and a powerful rocket motor producing a large exhaust plume.

ATGMs are typically guided by sensors or data links mounted on either the nose (a terminal homing seeker viewing the target) or the tail (sources and sensors viewing back to the launcher's fire control system, as in Command-to-Line-of-Sight (CLOS) or Laser Beam Rider (LBR)). It is generally considered impractical to employ a seeker on an anti-tank HVM due to the small diameter and finely tapered nose shape and the severe thermal environment produced on the nose by Mach 5 flight at low altitudes. It is likewise difficult to devise a guidance data link on the tail of the HVM missile because this arrangement causes the sources/sensors to be proximate to the typically large rocket motor exhaust nozzle and necessitates the transmission of the data through much of the large signal-absorbing plume the nozzle produces. Techniques to minimize these effects, such as locating the receiver on pods offset from the missile axis, are often expensive and/or performance-degrading. FIG. 1 shows the direct communication link used in existing LBR guidance systems. In order to avoid communication through the motor plume, the missile-borne, rear-looking light detector must be placed in an offset position relative to the axis of the missile. The signal-to-noise margin associated with this communication link is strongly dependent on the length of the offset and the surface area of the detector, factors that directly degrade missile velocity. The performance-degrading weight and surface area associated with the pod used to house this detector is usually exacerbated by the need to balance the aerodynamic load with another pod mounted on the opposite side of the missile.

A way to by-pass these difficulties is to use an indirect communication path from the launcher to the missile. Electromagnetic radiation (i.e. light) is known to scatter off the naturally occurring particles and molecules in the atmosphere. If, for example, a laser beam of sufficient power is transmitted from the launcher through the air and offset to one side of the flight path of a missile, thus bypassing the plume, light will be scattered laterally from the beam onto the side of the missile. Such scattering effect can be easily observed as the visible column of light from a search-light against the night sky. Appropriate sensors on the side of the missile can receive this signal for guidance purposes. This side-scatter communication approach, therefore, avoids both the aerodynamic and the plume interference difficulties mentioned above.

There are various ways in which the scattering laser beam can be used to impart missile position information to the sensors so that the missile can guide itself along the desired trajectory to the target. The prior art includes three patents (U.S. Pat. Nos. 5,374,009; 5,664,741; 6,138,944) each of which describes the creation of an off-axis guidance link using the existing low pulse rate laser, such as the U.S. Army's Ground Laser Locator Designator (GLLD), normally used in conjunction with semi-active missile systems such as HELLFIRE. U.S. Pat. Nos. 5,374,009 (Walter E. Miller, Jr. et al.) and 6,138,944 (Wayne L. McCowan et al.) teach a guidance technique known as scatter-rider. The Miller et al. system was devised as a limited-accuracy initial guidance mode for a terminal homing seeker missile. The missile employs side-looking receivers to detect energy indirectly from the laser designator by way of atmospheric scattering. Amplitude differences in the level of received energy associated with these receivers are used by the missile's processor to keep the missile close enough to the beam axis to permit handoff to the more accurate terminal guidance mode at the appropriate time during the missile flight. The McCowan system was devised as a limited-accuracy, low-cost retrofit to small unguided rockets. Again, the GLLD's narrow laser beam is transmitted directly on the line of sight to the target. The missile employs both forward and rearward canted side-looking receivers, as illustrated in FIG. 2. Time differences in the temporal waveforms associated with the detected energy are used to determine the approximate lateral direction and distance to the beam. This information allows the missile to turn continuously toward the beam and, thusly, fly roughly down the line of sight to the target. This approach has limited accuracy because the missile sensors cannot determine the direction to the beam center when actually inside the laser beam. As a consequence, it tends to wander off the ideal line-of-sight flight path more than the proven CLOS and LBR guidance systems. However, this limited accuracy was deemed acceptable for a low-cost retrofit of a small unguided rocket but would be inadequate for an anti-tank HVM.

In a variation of scatter-rider, U.S. Pat. No. 5,664,741 (Jimmy R. Duke) adds a circular scanning optical system in front of the same low pulse rate laser to cause the laser beam to describe a circle about the desired flight path. The laser pulses are synchronized with the scan to occur at four fixed locations about the line of sight. The side-looking sensors have multiple narrow fields-of-view so that the direction to each laser pulse can be measured and combined with the others in a scan to calculate missile position relative to the center of the scan circle (the desired flight path). This approach overcomes scatter-rider's loss of accuracy near the line of sight, but is still insufficiently accurate for long range precision guidance applications due to the practical limits of the segmented receiver's optical system. Increasing the accuracy of the approach would require a greater number of smaller segments, at the cost of reducing the guidance link's signal-to-noise margin. In addition, the approach incurs a loss of guidance data rate by requiring multiple pulses (typically 4) to be used for each position calculation. The semi-active target designation lasers operate at 10 to 20 pulses per second, providing a guidance data rate of only 5 Hz, inadequate for hypervelocity flight.

It is the object of this invention to provide a guidance system that combines the advantages of side-scatter communications described above with full accuracy and high data rate for a kinetic energy ATGM missile.

SUMMARY OF THE INVENTION

In accordance with this invention, a beamrider guidance link is provided in which a pulsed laser projects into the guidance field a beam that is spatially encoded with azimuth and elevation scans of pre-determined angles. This encoded beam is indirectly relayed to side-looking missile-borne receivers by way of scattered radiation effected by atmospheric particles. Multiple optical receivers mounted on the side of the missile, each receiver having a different field-of-view (FOV) from its adjacent receivers, receive light from the transmitting laser that is thusly scattered by atmospheric particles. In response to the received scattered radiation, the missile's signal processor calculates the missile's position within the guidance field by determining the precise time at which the detection of scattered beam shifts from one receiver to an adjacent receiver. It then generates steering commands necessary to remain in or near the center of the guidance field, which center is normally coaxial with the target line-of-sight (LOS).

DESCRIPTION OF THE PREFERRED EMBODIMENT

Figure 1:
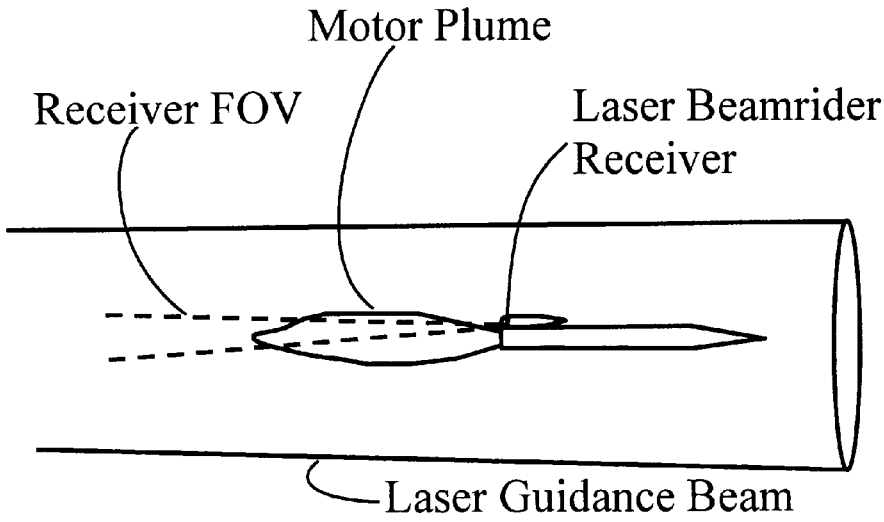
FIG. 1 Prior Art
FIG. 1 shows the direct communication link used in existing Beamrider guidance systems wherein rearward-looking light detectors are placed in an offset position relative to the axis of the missile in order to reduce the communication degradation caused by the motor plume.
Figure 2:
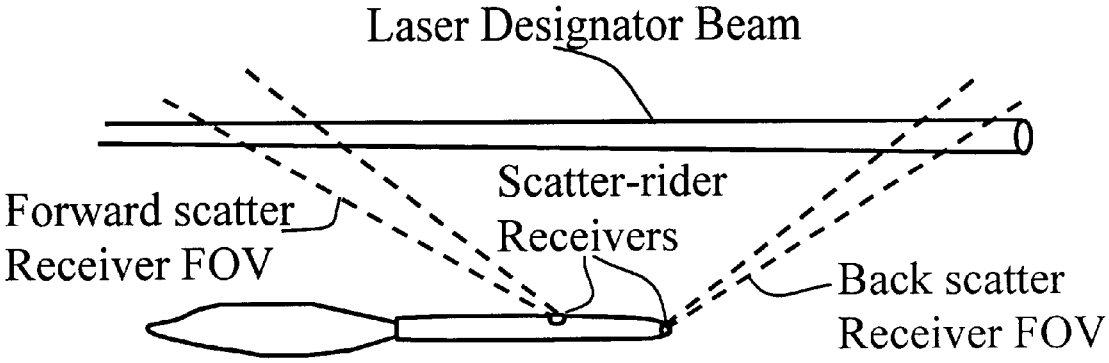
FIG. 2 Prior Art
FIG. 2 illustrates Scatter-rider guidance utilizing light from the laser beam that is reflected off atmospheric particles in random directions and detected by missile-borne detectors possessing different side-looking fields-of-view.

Referring now to the drawing wherein like numbers represent like parts in each of the several figures and lines with arrowheads indicate optical paths, the structure and operation of Side-Scatter Beamrider Missile Guidance System are described in detail.

Figure 3:
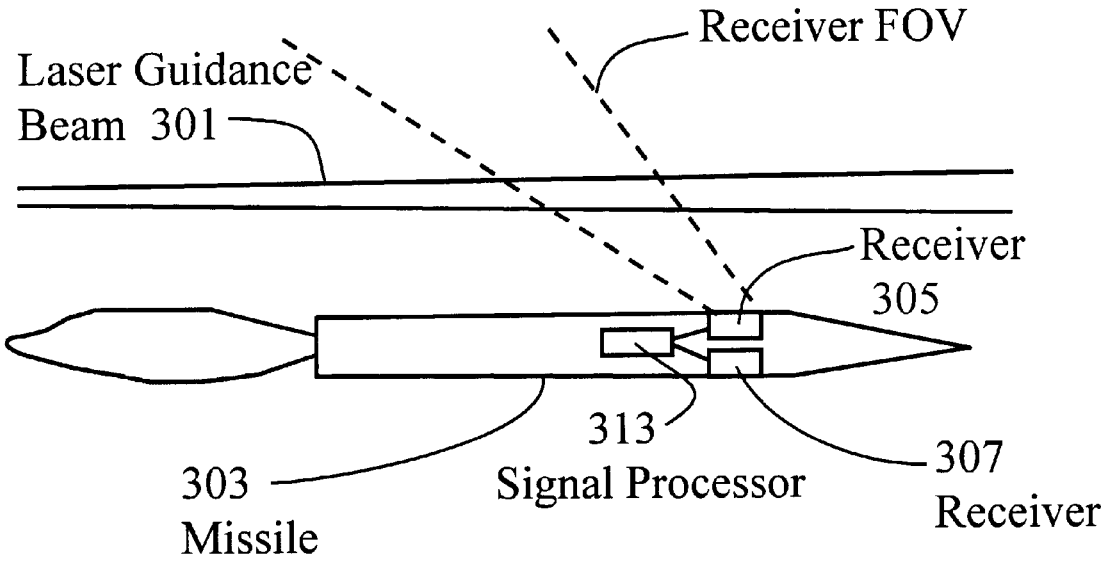
FIG. 3 describes the communication-link geometry of the Side-Scatter Beamrider Missile Guidance System in accordance with the invention.

As illustrated in FIG. 3, the Side-Scatter Beamrider Missile Guidance System allows guidance beam 301 to be offset from the axis of missile 303 and, therefore, from the motor plume. This avoids the plume-caused degradation in the communication link with the four side-looking optical receivers, of which only first receiver 305 and second receiver 307 are shown in the figure. Each of the four optical receivers mounted onto the side of the missile has a 90-degree field-of-view (FOV) and together they provide a complete 360-degree FOV around the missile. In operation of the Side-Scatter Beamrider Missile Guidance System, first receiver 305, for example, receives the pulsed beam that is scattered from atmospheric particles when the scattered beam is within its own 90-degree FOV. The pulsed beam is continuously scanned up and down, then left and right, thereby creating a spatially encoded guidance field. As the scan angles change, however, the scattered beam exits the FOV of the first receiver and enters the FOV of adjacent receiver, second optical receiver 307. The time of this shift of received energy between adjacent receivers is used by signal processor 313 to determine the position of the missile relative to guidance field 503.

Figure 4:
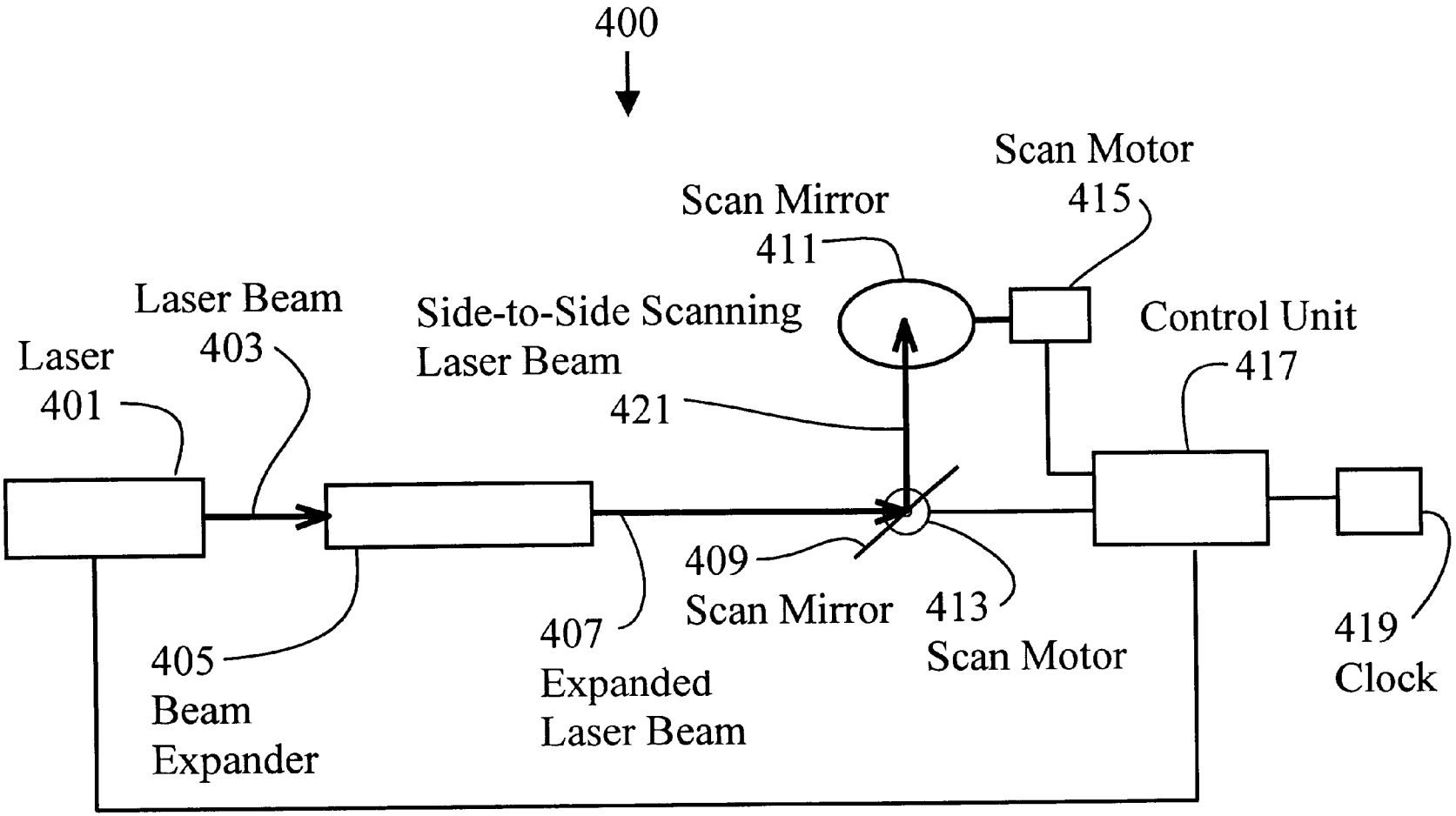
FIG. 4 illustrates the preferred embodiment of the Side-Scatter Beamrider beam projector.

The production and emission of pulsed beam and the detection of the scattered pulsed beam is explained in further detail with reference to beam projector 400 illustrated in FIG. 4 and the optical receivers diagrammed in FIG. 6. Beam projector 400 is located at the missile launcher and is activated prior to or simultaneously with the launch of missile 303.

Figure 5:
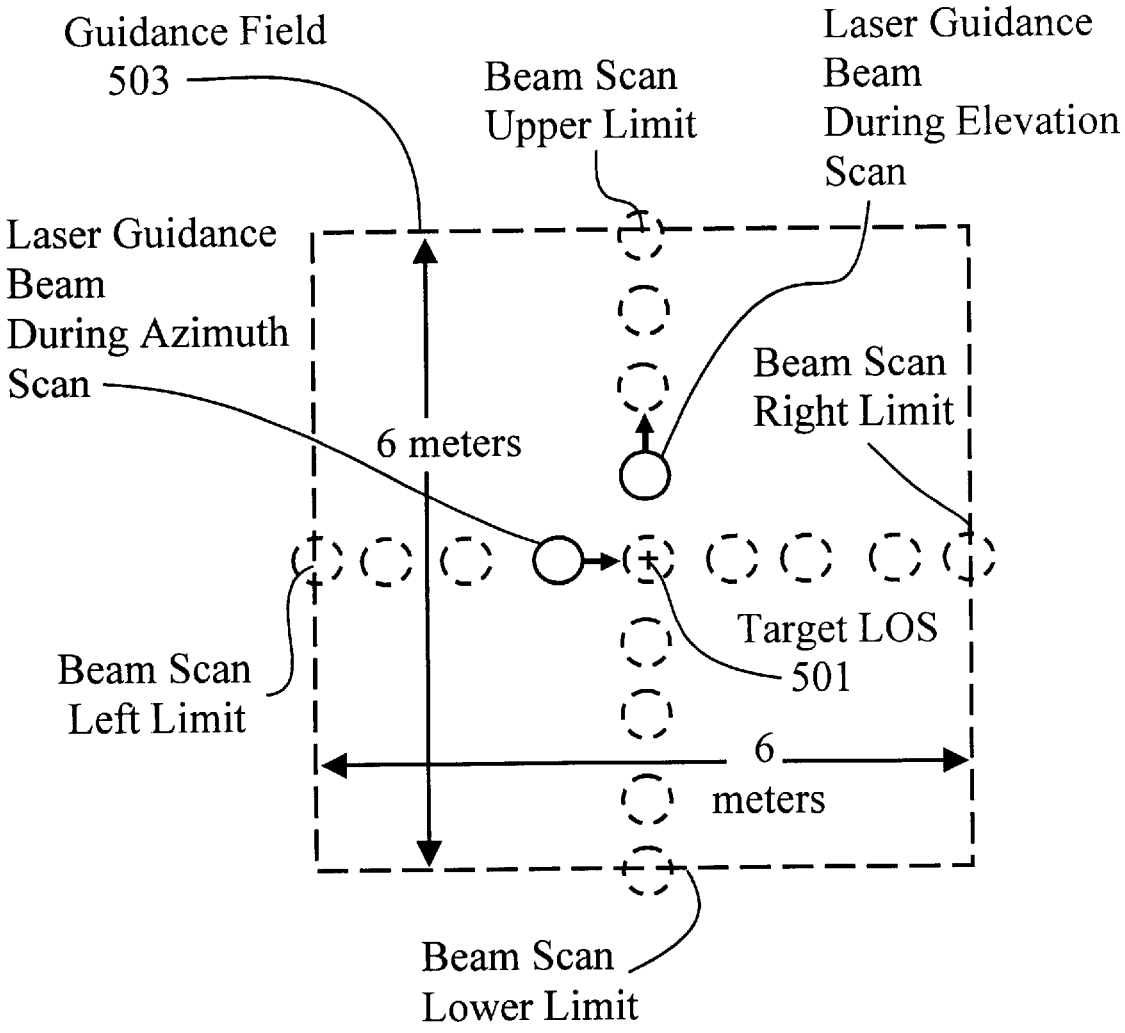
FIG. 5 is a graphic illustration of the guidance field as it is viewed from the missile launcher.

Output beam 403 of repetitively pulsed laser 401 is directed through beam expander 405 to become expanded laser beam 407. The expansion of the beam diameter reduces the angular beam divergence so that the beam diameter is less than 1 meter at maximum target range. The expanded beam is then directed to be incident on and be deflected by first rotationally vibrating scan mirror 409 and subsequently by second rotationally vibrating scan mirror 411, one mirror deflecting the beam in azimuth while the other deflects in elevation. The two scanning mirrors are arranged with respect to each other so as to enable the deflected laser beam 421 from first scan mirror 409 to impinge on second scan mirror 411. In FIG. 4, the first scan mirror deflects in azimuth and the second scan mirror deflects in elevation and are driven by first scan motor 413 and second scan motor 415, respectively. The beam, upon being encoded with pre-selected scan angles, either in azimuth or elevation or both, then exits the beam projector via the second scan mirror toward the target, in the direction represented as out of the plane of the paper in FIG. 4. The pulse frequency, the alternating sequence between azimuth and elevation scans, and the degree of amplitude of the scan angles are all determined and controlled by electronic control unit 417 that is coupled simultaneously between laser 401 and scan motors 413 and 415. The control unit is pre-programmed with the missile's known range profile (i.e. missile range vs. time). Further, the control unit has therein or is coupled to first clock 419 which, along with the missile range profile information resident in the control unit, allows the control unit to control the angular scan amplitude so that the length of the scan at the missile is maintained constantly at the pre-selected guidance field size as the missile flies toward the target. FIG. 5 is a graphic illustration of the guidance field 503 thusly produced, as it is viewed from the missile launcher, with target line-of-sight 501 coinciding with the center of the guidance field. The figure shows the pre-selected guidance field size as being 6 meters by 6 meters. This is a typical size for guidance fields; however, the guidance field can be manipulated to be any size dictated by the missile dynamics, such as perturbation of the missile in flight, whether the target is moving and, if moving, how fast. For example, if the guidance field is required to be larger, say 9 meters by 9 meters, then the scan angles need to be made correspondingly larger.

Figure 6:
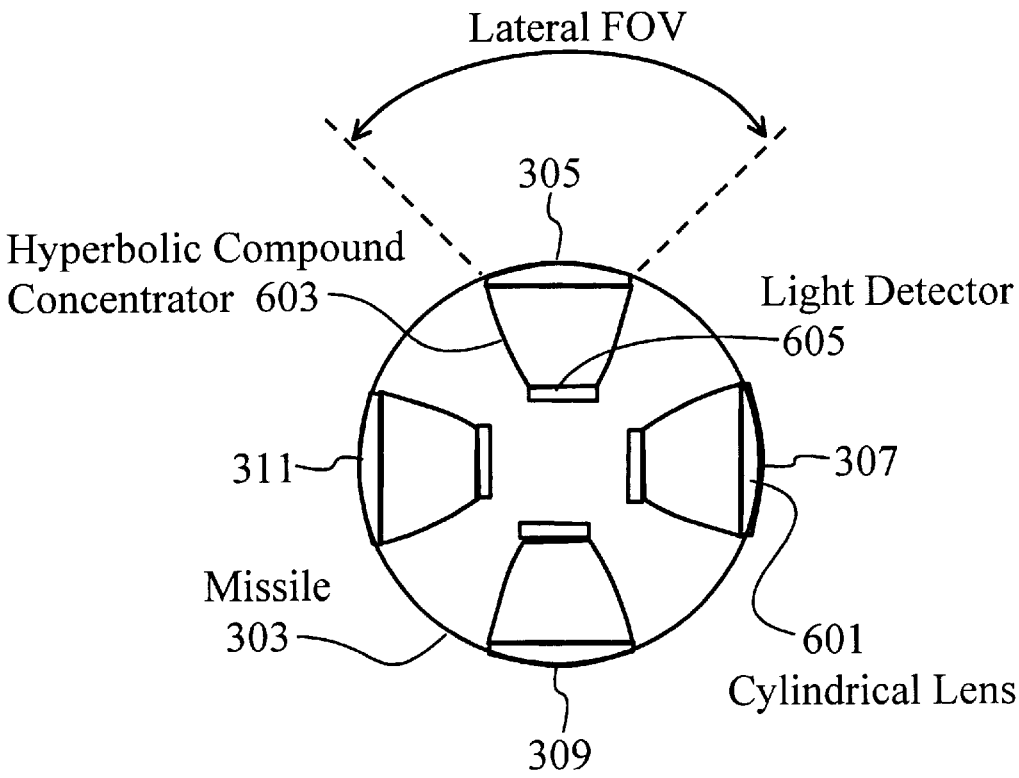
FIG. 6 illustrates the preferred embodiment, deployment and lateral FOV of a representative receiver.

FIG. 6 illustrates the preferred embodiment of the Side-Scatter Beamrider missile-borne receivers that detect scattered laser energy originating from beam projector 400.

Figure 7:
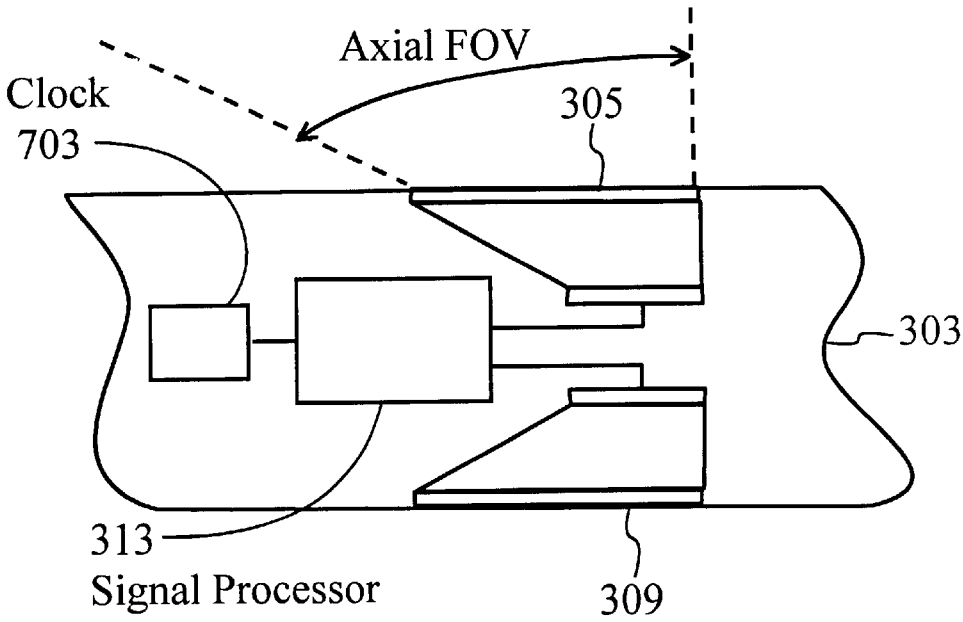
FIG. 7 illustrates the axial FOV of a representative receiver and the means for signal processing that resides in the missile.

First, second, third and fourth side-looking receivers 305, 307, 309 and 311, respectively, are shown, each configured identically with a 90-degree field-of-view and oriented laterally at 90-degree intervals from the adjacent receiver on the exterior surface of the missile, so as to achieve jointly a complete 360-degree field-of-view around the missile. FIG. 6 illustrates the lateral FOV of a representative receiver while FIG. 7 illustrates the axial FOV of the receiver and the means for signal processing that resides in missile 303. Each of the identical receivers is an optical collection system comprising cylindrical lens 601 via which the scattered energy enters the receiver, detector 605 (which may be of silicon) for detecting the energy and generating corresponding electrical signals, and hyperbolic compound concentrator 603 coupled between the cylindrical lens and the detector for collecting the received energy onto the detector. It is the use of the hyperbolic compound concentrator that provides the near-ideal collection efficiency with very sharp cut-offs at the field-of-view edges when the shift occurs between two adjacent receivers in the receipt of the scattered energy. An alternative, serviceable, embodiment of the receivers may comprise an optical plate for transmitting scattering energy therethrough and a parabolic concentrator to cause the energy to impinge on the detector. However, this embodiment is not as effective in providing the sharp cut-offs at the field-of-view edges when the detection shift occurs between adjacent receivers. Second clock 703 determines the exact time of the occurrence of the shift in energy receipt from one receiver to the adjacent receiver. These receivers are coupled to signal processor 313, which, in turn, is coupled to the second clock. The processor, in response to the electrical signals input from the differently-positioned receivers and the shift-time input from the second clock, produces position signals that are indicative of the missile's position relative to the target LOS (guidance field center). These position signals in azimuth and elevation are sent to the missile's flight computer for generation of the command signals necessary to steer the missile closer to the target LOS.

Prior to the launch, in order to obtain the missile position relative to the LOS, second clock 703 in the missile is made to be synchronous with first clock 419 in the beam projector that controls the scanning mechanism. In this way, the signal processor in the missile has continuous knowledge of the transmitting laser beam's scan angle. Since the guidance field is held at a constant size, there is a fixed relationship, throughout the missile flight, between the beam projector's scan angles and the linear position of the beam within the guidance field. The signal processor determines the missile's position within the guidance field by noting the time at which the forward-scattered laser energy exits one receiver's FOV and enters the FOV of an adjacent receiver. In other words, since the guidance field is held at a constant size at the missile throughout the missile's flight, the scan angle that corresponds with the time at which each receiver begins and stops receiving laser energy, as determined by its FOV, provides a measurement of the missile's azimuth or elevation position, depending on which axis is being scanned, within the guidance field. The beam position associated with this shift-time corresponds to the position of the missile within the guidance field. The accuracy of this position measurement is limited only by the repetition rate of the beam projector and the degree of the sharpness of the edges of the fields-of-view, as they both dictate the precision with which the energy shifting points can be determined. For applications in which clock synchronization cannot be maintained or wherein the clock drift may become large enough to affect accuracy adversely, the pulse rate of the beam projector can be encoded with the angle of the scan mirrors. With this arrangement, the signal processor can determine the beam scan angle by measuring the time interval between the laser pulses received.

Figure 8:
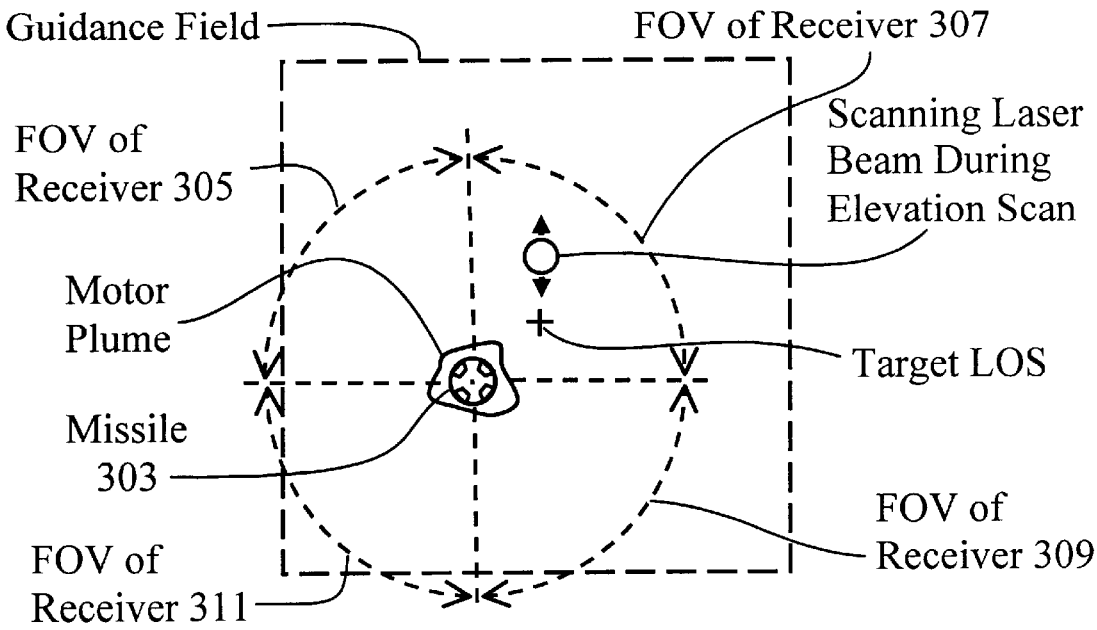
FIGS. 8 and 9 give a front view and a side view, respectively, of a complete side-scatter beamrider guidance field produced by the beam projector wherein the four side-looking missile-borne receivers utilize forward scattering to establish the communication link between the beam projector and missile-borne light detectors.
Figure 9:
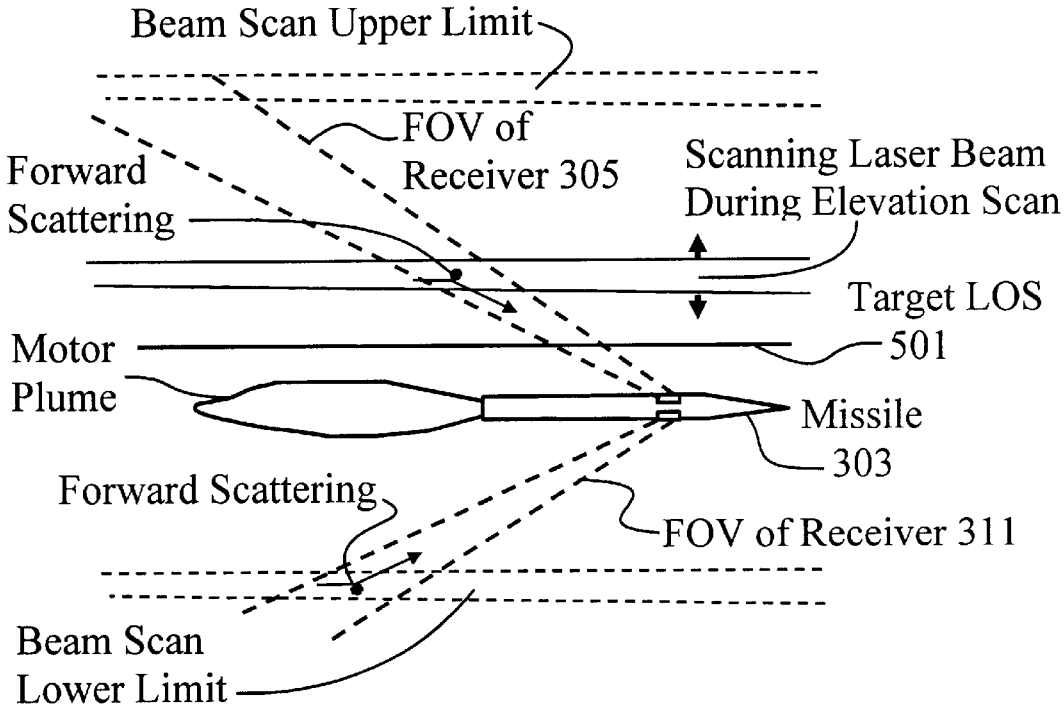
Figure 10:
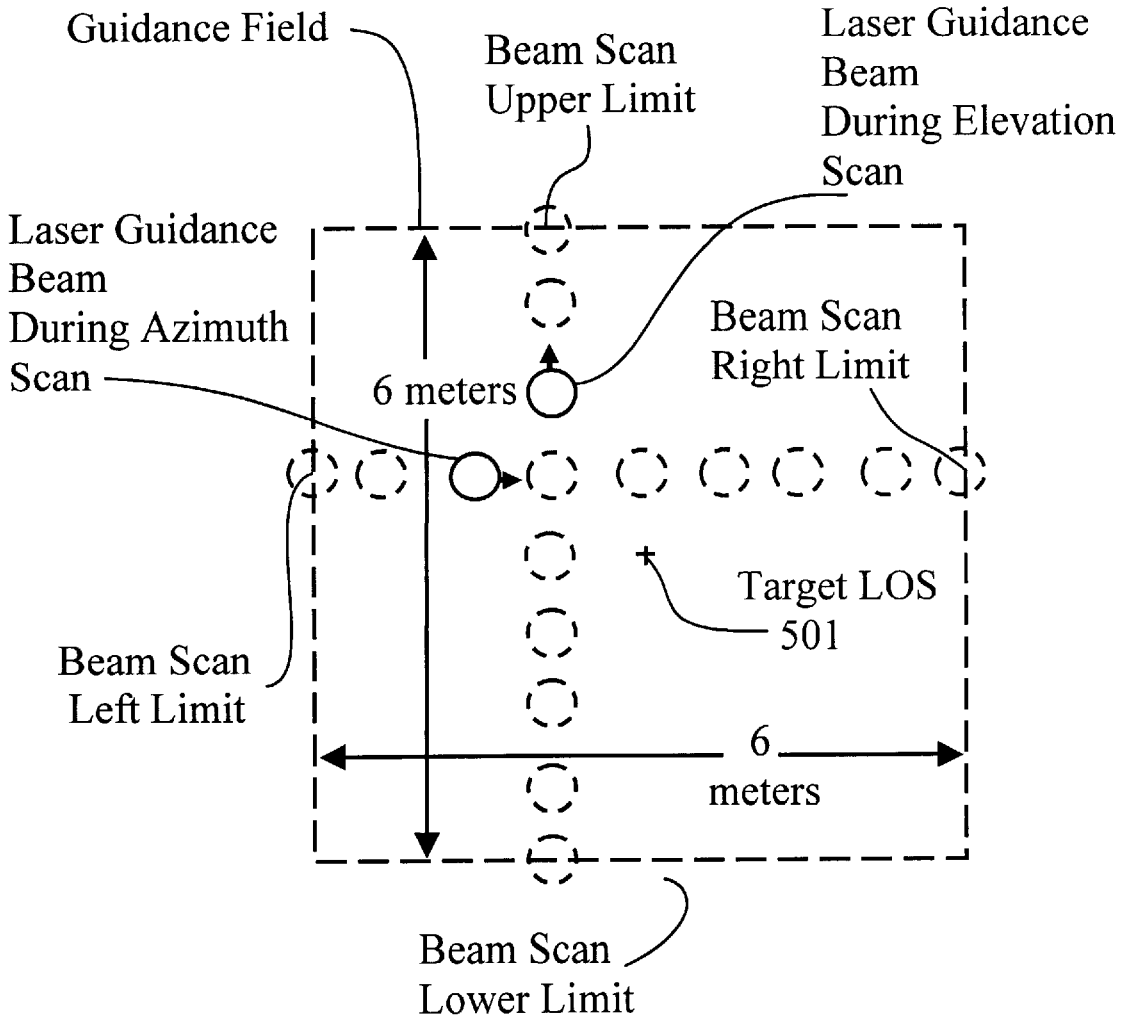
FIG. 10 shows a scan pattern that is offset relative to the LOS to preserve maximum accuracy when the missile is on target LOS.

FIGS. 8 and 9 illustrate the manner in which beam projector 400 produces a complete beamrider guidance field wherein the four side-looking missile-borne receivers (305, 307, 309 and 311) use forward scattering to establish indirectly the communication link between the beam projector and missile-borne light detectors. FIG. 8 is a frontal view of the guidance field, as seen from the target, at one instant in a typical missile flight, while FIG. 9 is a side view of exactly the same instant in flight. The target LOS is placed in the center of the guidance field as defined by the limits of the beam's elevation and azimuth scan angles. For illustrative purposes, the missile is arbitrarily chosen to be below and left of the target LOS for the particular instant of time depicted in FIGS. 8 and 9. As shown in FIG. 8, the missile is roll stabilized and oriented so as to align the fields-of-view of receivers 305 and 307 with the upper semicircle of the combined 360-degree field-of-view. Accordingly, receivers 309 and 311 are aligned with the lower semicircle, 307 and 309 with the right, and 305 and 311 with the left. Although this preferred embodiment assumes a non-rolling missile, the Side-Scatter Beamrider Missile Guidance System is also applicable to a rolling missile incorporating a roll gyro. At the illustrated point in the elevation scan, forward scattering along the axis of the laser beam will result in a portion of the transmitted energy being scattered toward detector 307, as indicated by the asterisk in FIG. 9. At this point in the scan and for this position of the missile, none of the laser energy scattered by the atmosphere can be received by detectors 305, 309 or 311. As the elevation scan of the laser advances, receiver 307 continues to receive laser energy until the laser beam exits its FOV and enters an adjacent receiver's FOV (receiver 309 for this missile position). It is the time of occurrence of this shift of received energy between adjacent detectors that is used by the missile's signal processor to determine the missile's position within the guidance field. A significant benefit of this spatial encoding method is the fact that the beam axis is scanned across the guidance field, thus reducing the offset distance between the receivers and the laser beam at these energy shifting points, and thereby increasing the signal-to-noise margin of the received signals associated with these points, as is stated above. Of course, the actual beam/receiver offset distance is dependant on missile position and the extent of the obscuring motor plume when the missile is close to the target LOS. To preserve maximum accuracy when the missile is on target LOS, the scan pattern could be offset relative to the LOS as illustrated in FIG. 10. When the missile's position is coincident with either scan axis, the energy shift between adjacent detectors can become less precise due to plume obscuration. The offset arrangement in FIG. 10 preserves the precision of the energy shift between adjacent detectors when missile positions are close to the LOS.

A 10 kHz, 4 mJ commercially-available laser is capable of producing a Side-Scatter Beamrider guidance field as described above at a 100 Hz data rate (one complete azimuth and elevation scan in 10 mSec) with accuracies consistent with fielded beamrider guidance systems that possess range capabilities out to 5 km.

Although a particular embodiment and form of this invention has been illustrated, it is apparent that various modifications and embodiments of the invention may be made by those skilled in the art without departing from the scope and spirit of the foregoing disclosure. Accordingly, the scope of the invention should be limited only by the claims appended hereto.

We claim:

1. A Side-Scatter Beamrider Guidance System for utilizing laser guidance beam that is scattered by atmospheric particles to steer a missile in its flight toward impact on a pre-selected target, said guidance system comprising: a beam projector for producing and emitting said laser guidance beam in the direction of said target, said beam projector comprising a laser source for outputting a laser beam of pre-determined pulse frequency, said beam being directed to move in azimuth and in elevation sufficiently to describe a guidance field of given dimensions, the center of said guidance field coinciding with the line-of-sight to said pre-selected target, said projector further having therein a means for directing said beam to achieve any given azimuth and elevation, said laser source being located at the missile launcher and being activated prior to or simultaneously with the launch of said missile, said beam projector further comprising a first scan mirror and a second scan mirror, said mirrors deflecting incident laser beam in azimuth and in elevation, respectively, wherein said first and second scan mirrors are scannable by pre-chosen scan amplitudes and are driven by first and second scan motors, said first and second scan motors being coupled to said first and second scan mirrors, respectively, said mirrors further being aligned with respect to each other and to said source such that said laser beam from said source is incident on and deflected by both said mirrors in sequence, said laser beam finally being emitted outwardly in the direction of said pre-selected target; a means for detecting guidance beam scattered by said atmospheric particles and producing electrical signals in response thereto, said detecting means being located on the missile; a signal processor coupled to said detecting means, said processor receiving said electrical signals from said detecting means and calculating therefrom position signals indicative of the position of said missile relative to said line-of-sight, said position signals steering said missile to fly toward a more direct impact on said pre-selected target.

2. A Side-Scatter Beamrider Guidance System as set forth in claim 1, wherein said beam projector further comprises: a control unit coupled simultaneously to said laser source for controlling the pulse frequency of said laser beam and to said scan motors, said control unit having therein a means for driving said scan motors so as to maintain a constant size of said guidance field at said missile as said missile flies downrange toward said target.

3. A Side-Scatter Beamrider Guidance System as set forth in claim 2, wherein said means for driving said scan motors so as to maintain a constant size of said guidance field at said missile comprises missile range profile information residing within said control unit and a first clock, said first clock being coupled to said control unit, said clock and said missile range profile information cooperating together to enable said control unit to determine and control said angular scan amplitudes of said scan mirrors so as to maintain a constant size of said guidance field at said missile as said missile flies downrange toward said target.

4. A Side-Scatter Beamrider Guidance System as set forth in claim 3, wherein said beam projector still further comprises a beam expander coupled between said laser source and said first scan mirror, said beam expander expanding the diameter of said beam so as to reduce the angular beam divergence.

5. A Side-Scatter Beamrider Guidance System as set forth in claim 4, wherein said detecting means comprises: a plurality of identical optical receivers positioned on the exterior surface of said missile, said receivers each having a 90-degree field-of-view and jointly achieving a 360-degree field-of-view around said missile and at least one of said receivers detecting the guidance beam scattering from atmospheric particles until a change in azimuth or elevation of said guidance beam causes the detection occurrence to shift to an adjacent receiver.

6. A Side-Scatter Beamrider Guidance System as set forth in claim 5, wherein said optical receivers are four in number and are oriented laterally at 90-degree intervals around said missile.

7. A Side-Scatter Beamrider Guidance System as set forth in claim 6, wherein each of said identical optical receivers comprises: a cylindrical lens for transmitting scattered laser beam therethrough; a detector for detecting received scattered laser beam; and a hyperbolic compound concentrator for collecting received scattered laser beam, said concentrator being coupled between said lens and said detector, said concentrator providing the near-ideal collection efficiency with very sharp cut-offs at the field-of-view edges when shift occurs from one of said receivers to an adjacent receiver in the detection of the scattered laser beam.

8. A Side-Scatter Beamrider Guidance System as set forth in claim 7, wherein said guidance system further comprises a second clock located in said missile and coupled to all of said optical receivers and to said signal processor, said second clock tracking the time of the occurrence of detection shift from one receiver to said adjacent receiver.

9. A Side-Scatter Beamrider Guidance System as set forth in claim 8, wherein said second clock and said first clock are synchronized so as to enable said signal processor to have continuous knowledge of the transmitting laser beam's scan angle.

10. A Side-Scatter Beamrider Guidance System as set forth in claim 9, wherein said signal processor, in response to said time of shift occurrence, determines the position of said missile within said guidance field.

11. Side-Scatter Beamrider Guidance System for utilizing laser guidance beam that scatters from atmospheric particles to steer a missile in its flight accurately toward impact on a pre-selected target, said guidance system comprising: a means for producing and emitting said laser guidance beam in the direction of said target, said beam having a pre-determined pulse frequency and being directed to move in azimuth and elevation sufficiently to describe a guidance field of given dimensions, the center of said guidance field coinciding with the line-of-sight to said pre-selected target, said producing and emitting means further having therein a means for directing said beam to achieve any given azimuth and elevation; a plurality of optical receivers for detecting guidance beam scattering from said atmospheric particles, said receivers being positioned on the exterior surface of said missile so as to achieve jointly a 360-degree field-of-view; a first clock coupled to said directing means a second clock located within said missile, said second clock being coupled to said receivers and used for determining the precise time at which the energy detection shifts from one of said receivers to an adjacent receiver; a signal processor coupled to said receivers and to said second clock, said processor receiving energy signals from said receivers and identifying the particular detecting receiver at a particular time and calculating, in response to said energy signals and time input, position signals indicative of the position of said missile relative to said line-of-sight so as to enable said missile to fly toward a more direct impact on said pre-selected target.

12. A Side-Scatter Beamrider Guidance System as described in claim 11, wherein said producing and emitting means comprises: a laser source for outputting a laser beam of pre-determined pulse frequency, said source being located at the missile launcher and being activated prior to or simultaneously with the launch of said missile; a first scan mirror for deflecting incident laser beam in azimuth and a second scan mirror for deflecting incident laser beam in elevation, said mirrors being aligned with respect to each other and to said source such that said laser beam from said source is incident on and deflected by both said mirrors in sequence, eventually to be emitted outwardly in the direction of said pre-selected target.

13. A Side-Scatter Beamrider Guidance System as described in claim 12, wherein said producing and emitting means further comprises: a control unit coupled simultaneously to said laser source for controlling the pulse frequency of said laser beam and to said scan mirrors, said control unit having therein a means for driving said scan mirrors so as to maintain a constant size of said guidance field at said missile as said missile flies downrange toward said target.

14. A Side-Scatter Beamrider Guidance System as described in claim 13, wherein said plurality of optical receivers are four identical optical receivers, each receiver comprising: a cylindrical lens for receiving scattered laser beam therethrough; a detector for detecting received laser beam; and a hyperbolic compound concentrator coupled between said lens and said detector, said concentrator providing the near-ideal collection efficiency with very sharp cut-offs at the field-of-view edges when shift occurs in the detection of the scattered laser beam between two adjacent receivers.

15. A Side-Scatter Beamrider Guidance System as described in claim 14, wherein said first and second clocks are synchronized with each other so as to enable said signal processor to have continuous knowledge of the transmitting laser beam's scan angles.

16. A Side-Scatter Beamrider Guidance System as described in claim 15, wherein said signal processor, in response to said time of shift occurrence, determines the position of said missile within said guidance field.

* * * * *